US007360485B2

(12) United States Patent
Kawamura et al.

(10) Patent No.: US 7,360,485 B2
(45) Date of Patent: Apr. 22, 2008

(54) PLANOGRAPHIC PRINTING PLATE FEEDING APPARATUS

(75) Inventors: Yoshinori Kawamura, Kanagawa (JP); Kikuo Matsuba, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 425 days.

(21) Appl. No.: 11/071,442

(22) Filed: Mar. 4, 2005

(65) Prior Publication Data

US 2005/0193912 A1 Sep. 8, 2005

(30) Foreign Application Priority Data

Mar. 4, 2004 (JP) ..... 2004-060912

(51) Int. Cl.
*B41L 47/14* (2006.01)

(52) U.S. Cl. ..... 101/477; 271/109; 271/117

(58) Field of Classification Search ..... 101/477; 271/109, 110, 117
See application file for complete search history.

(56) References Cited

U.S. PATENT DOCUMENTS 3,228,711 A * 1/1966 Merchak ..... 270/1.01
3,260,521 A * 7/1966 Moxness ..... 271/116
5,346,199 A * 9/1994 Martin et al. ..... 271/110
6,729,237 B2 5/2004 Kawamura et al.
2002/0185804 A1* 12/2002 Wood et al. ..... 271/10.01
2004/0134367 A1* 7/2004 Kawamura et al. ..... 101/477
2005/0242491 A1* 11/2005 Howell ..... 271/167

FOREIGN PATENT DOCUMENTS

EP 1 319 616 A2 6/2003
JP 60-202028 A 10/1985
JP 05116779 A * 5/1993
JP 2003-182904 A 7/2003

* cited by examiner

*Primary Examiner*—Leslie J. Evanisko
(74) *Attorney, Agent, or Firm*—Sughrue Mion, PLLC

(57) ABSTRACT

In a planographic printing plate feeding apparatus, a load W applied to a stack of plates by a pickup roller which feeds a planographic printing plate from the stack is adjusted. If the load W is increased and exceeds a single feeding threshold, and if a conveyance force F1 applied from the uppermost planographic printing plate to the slip-sheet is increased by such a degree that the conveyance force F1 exceeds a maximum static friction force F2' between the slip-sheet and the planographic printing plate under the slip-sheet, the uppermost planographic printing plate and the slip-sheet 22 can be conveyed integrally (set feeding). Hence, it is possible to obtain a planographic printing plate feeding apparatus with a compact, simple and inexpensive structure and able to feed a planographic printing plate swiftly and reliably.

17 Claims, 9 Drawing Sheets

PLANOGRAPHIC PRINTING PLATE FEEDING APPARATUS

CROSS-REFERENCE TO RELATED APPLICATION

This application claims priority under 35 USC 119 from Japanese Patent Application No. 2004-060912, the disclosure of which is incorporated by reference herein.

BACKGROUND OF THE INVENTION

1. Field of the Invention

The present invention relates to a planographic printing plate feeding apparatus, and more particularly, to a planographic printing plate feeding apparatus capable of feeding planographic printing plates one sheet at a time from a laminated stack in which laminated sets comprise planographic printing plates and slip-sheets.

2. Description of the Related Art

Generally, it is often the case that in a planographic printing plate, a protective slip-sheet is attached to the image recording surface thereof to constitute a laminated set, and the plural sets are laminated on one another in a thickness direction to constitute a stack of planographic printing plates. When images are to be recorded on planographic printing plates using an exposure apparatus, it is necessary to extract planographic printing plates from a stack of plates one sheet at a time and feed them to the exposure apparatus.

For example, in an image-recording material sheet-feeder described in Japanese Patent Application Laid-Open No. 2003-182904, printing plates and slip-sheets are alternately laminated and accommodated in a cassette of a sheet conveyance unit, a suction cup suctions the slip-sheet and the printing plate from above and the suction cup moves upward to extract them from the cassette. After the slip-sheet and the printing plate are extracted, the slip-sheet is suctioned by a fan and separated from the printing plate. With this structure, however, use of a suction cup for feeding a printing plate is potentially disadvantageous in terms of the structure being complicated and the cost of the apparatus increasing.

Japanese Patent Application Laid-Open No. 60-202028 describes a structure in which a slip-sheet located at an end surface in the laminated direction of the stack is fed by a roller, and a planographic printing plate is fed by a vacuum pad. According to this structure, however, since the planographic printing plates or the slip-sheets are extracted one sheet at a time, when the slip-sheet is located at the end surface in the laminated direction, the next planographic printing plate can be extracted only after this slip-sheet is extracted and, therefore, it takes time to feed the printing plates. Further, independent feeding mechanisms are required for both the planographic printing plate and the slip-sheet, which is potentially disadvantageous in terms of the number of parts being increased, and the apparatus being increased in size and cost.

SUMMARY OF THE INVENTION

The present invention has been accomplished in view of the above circumstances, so that the invention provides a planographic printing plate feeding apparatus with a compact, simple and inexpensive structure that is able to feed a planographic printing plate swiftly and reliably.

A first aspect of the present invention is a planographic printing plate feeding apparatus including: a mounting unit on which a stack of laminated sets comprising: planographic printing plates and slip-sheets is mounted; and a conveyance unit which can convey an uppermost set by applying a load and a conveyance force to a set stacked at an uppermost portion of the stack, and which applies, to the uppermost set, a load in a range such that the conveyance force (F0) applied to the uppermost set exceeds a maximum static friction force (F2') between the uppermost set and a next set.

A second aspect of the present invention is a planographic printing plate feeding apparatus in which laminated sets respectively comprising a planographic printing plate and a slip-sheet are laminated in a thickness direction to form a stack, and planographic printing plates are successively fed therefrom, the planographic printing plate feeding apparatus including: a conveyance unit which can convey an end surface set by applying a load and a conveyance force to a set at an end surface of the stack in a laminated direction, and which applies, to the end surface set, a load in a range such that the conveyance force (F0) applied to the end surface set exceeds a maximum static friction force (F2') between the end surface set and a next set; and a separating unit which separates the slip-sheet of the set conveyed by the conveyance unit from the planographic printing plate of the set.

That is, in this planographic printing plate feeding apparatus, the load applied to the end surface set by the conveyance unit is adjusted, and the conveyance force applied between the conveyance unit and the end surface set is greater than the maximum static friction force between the end surface set and the next set. Therefore, if the conveyance force is applied to the end surface set in this mode, the end surface set is fed by the friction between the end surface set and the conveyance unit, while the next set is prevented from being fed together with the end surface set.

The one set (one planographic printing plate and one slip-sheet attached to each other) extracted in the above manner can be separated into a planographic printing plate and a slip-sheet by the separating unit.

In the invention, since the sets can be extracted from the stack in units of at least one set, the next planographic printing plate can be swiftly extracted and fed. It is unnecessary to provide mechanisms separately or independently for the planographic printing plate and the slip-sheet, or a suction cup for removing the set. Therefore, the structure can be compact, simple and inexpensive.

Further, by adjusting the load applied from the conveyance unit to the end (top) surface set, it becomes possible to extract a planographic printing plate or a slip-sheet one by one, or to extract plural sets at once.

The conveyance unit may comprise a conveyance roller which applies a conveyance force by rotating in a state in which the conveyance roller is in contact with the end surface set. This design simplifies the structure of the conveyance unit.

The separating unit may comprise a forward-rotating roller which comes into contact with the slip-sheet which is being conveyed and which rotates in the same direction as the conveyance direction, and a reversely-rotating roller which comes into contact with the slip-sheet at a location downstream from the forward-rotating roller in the conveyance direction and which rotates in the opposite direction relative to the forward-rotating roller.

With this structure, the slip-sheet which is attached to the planographic printing plate is fed in the conveyance direction by the forward-rotating roller during the conveyance operation, but downstream to this a force in the direction opposite to the conveyance direction is applied by the reversely-rotating roller. Consequently, a sag is generated in the slip-sheet between the forward-rotating roller and the reversely-rotating roller and thus the slip-sheet can be separated from the planographic printing plate.

In order to generate the sag, it is simply necessary for the reversely-rotating roller to rotate reversely relative to the forward-rotating roller and thus in the opposite direction relative to the conveyance direction. For example, even if the reversely-rotating roller itself is rotating in a forward direction but rotating reversely relative to the forward-rotating roller (with a peripheral speed slower than that of the forward-rotating roller), the sag can be generated.

The reversely-rotating roller may be able to move between a contact position where the reversely-rotating roller comes into contact with the slip-sheet and a separated position where the reversely-rotating roller is disposed at a remove from the slip-sheet.

The reversely-rotating roller can be set at the contact position only when it is necessary to separate the slip-sheet from the planographic printing plate, and can be set at the separated position when it is unnecessary to separate the slip-sheet from the planographic printing plate, so that inadvertent contact of the reversely-rotating roller with the planographic printing plate can be prevented.

The separating unit may comprise a suction unit which suctions a slip-sheet to separate the same from a planographic printing plate.

Accordingly, a slip-sheet can be separated from a planographic printing plate simply by causing the suction unit to suction the slip-sheet which is attached to the planographic printing plate.

A detection sensor capable of detecting whether or not a planographic printing plate and/or a slip-sheet are present may be provided upstream of the separating unit in the conveyance direction.

According to the planographic printing plate feeding apparatus of the present invention, further to extracting a set (a set of one planographic printing plate and one slip-sheet), it is also possible to extract a single planographic printing plate or a single slip-sheet. It is also possible to convey none of the above by stopping the conveyance unit. Since the detection sensor can detect these four modes, it is possible to control the separating unit in accordance with the respective modes.

Since the planographic printing plate feeding apparatus of the invention has the above-described structure, it is possible to feed planographic printing plates one by one using a compact, simple and inexpensive structure.

BRIEF DESCRIPTION OF THE DRAWINGS

FIGS. 4A to 4C are explanatory diagrams illustrating modes of extracting planographic printing plates in the planographic printing plate feeding apparatus, wherein FIG. 4A shows a set feeding mode, FIG. 4B shows a single feeding mode and FIG. 4C shows a multiple feeding mode;

FIGS. 6A and 6B are explanatory diagrams showing separation of a slip-sheet at a slip-sheet separating unit in the first embodiment of the planographic printing plate feeding apparatus, wherein FIG. 6A shows a state in which a retard roller unit is in a first contact position, and FIG. 6B shows a state in which the retard roller unit is in a separated position;

FIGS. 8A and 8B are explanatory diagrams showing switching of the slip-sheet in the conveyance direction at the slip-sheet separating unit in the first embodiment of the planographic printing plate feeding apparatus of the invention, wherein FIG. 8A shows a state in which the retard roller unit is in a second contact position, and FIG. 8B shows a state in which the retard roller unit is in the separated position; and FIGS. 9A and 9B are explanatory diagrams showing a slip-sheet separation operation at the slip-sheet separating unit in a second embodiment of a planographic printing plate feeding apparatus of the invention, wherein FIG. 9A shows a state in which a suction fan is OFF, and FIG. 9B shows a state in which the suction fan is ON.

DETAILED DESCRIPTION OF THE INVENTION

Figure 1:
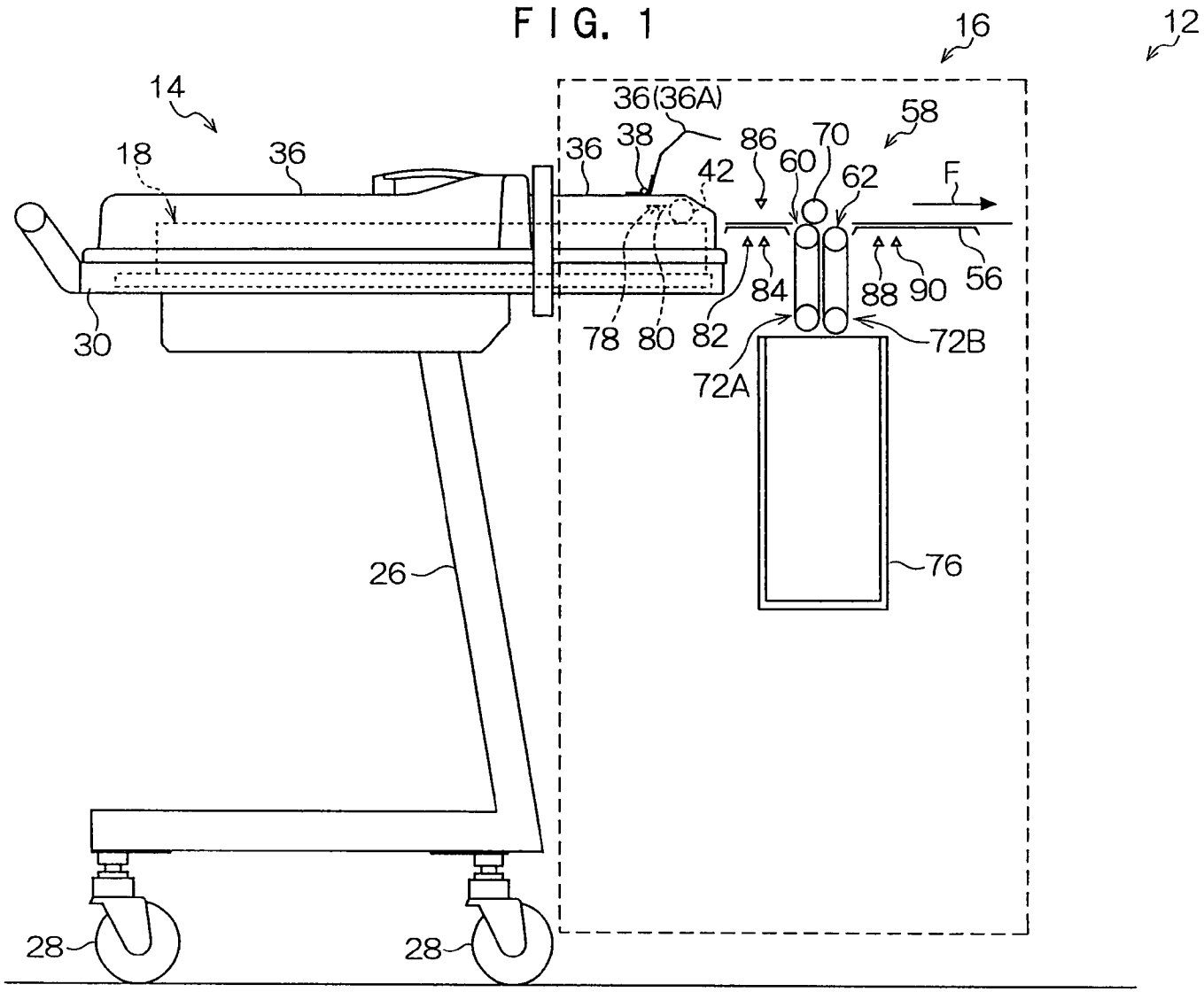
FIG. 1 is a side view showing a first embodiment of a planographic printing plate feeding apparatus of the invention.
Figure 2:
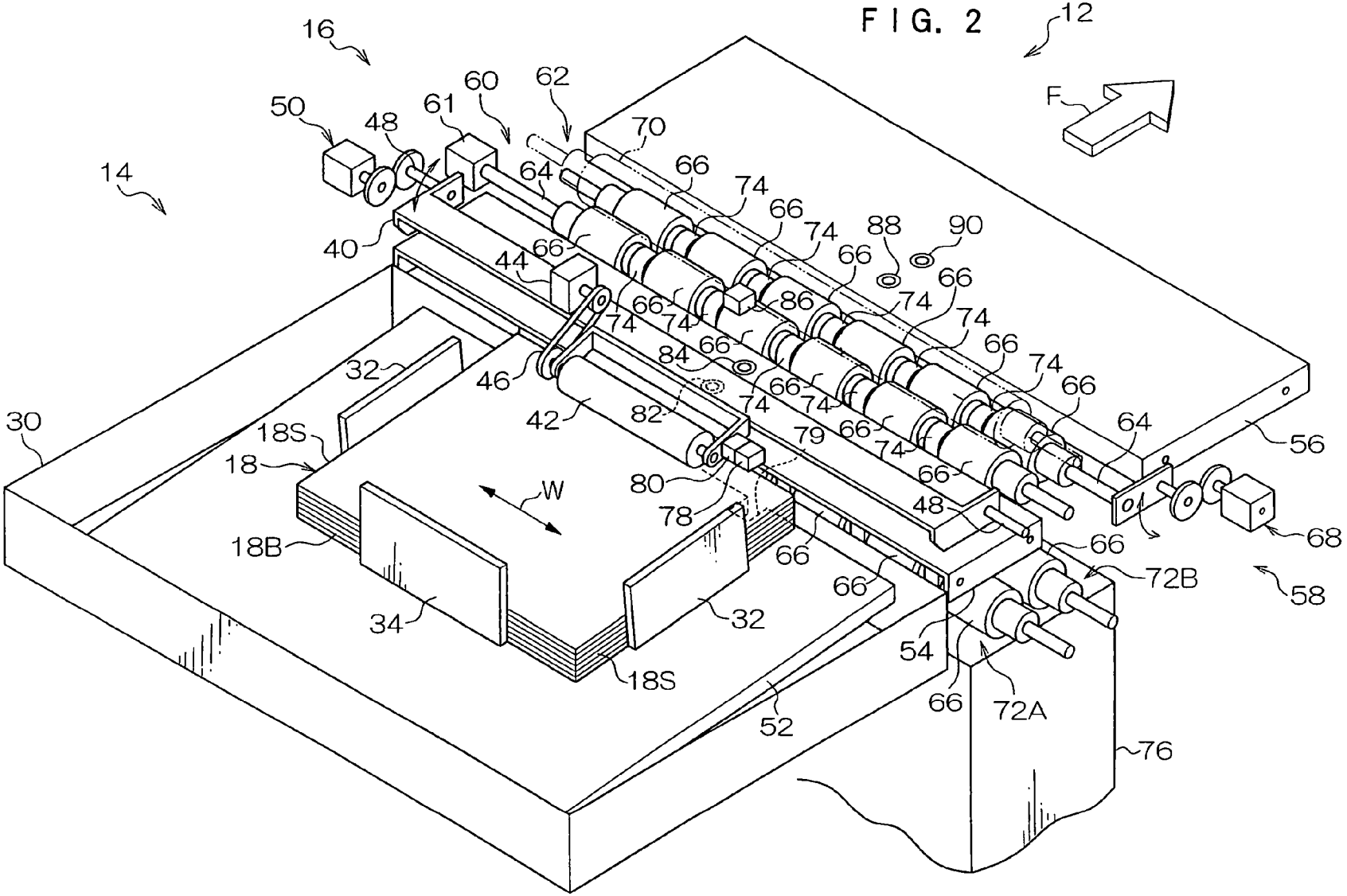
FIG. 2 is a perspective view of a mounting unit and a feeding unit of the first embodiment of the planographic printing plate feeding apparatus of the invention.

FIG. 1 shows an overall structure of a planographic printing plate feeding apparatus 12 of a first embodiment of the invention. FIG. 2 shows a mounting unit 14 on which a laminated stack 18 is mounted and a feeding unit 16 of the planographic printing plate feeding apparatus 12.

Figure 4C:
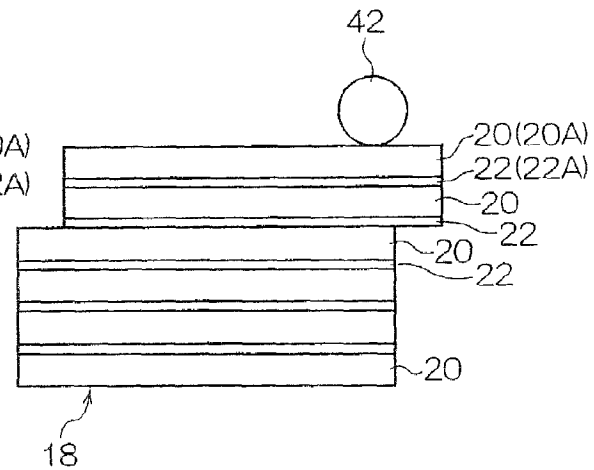
Figure 4B:
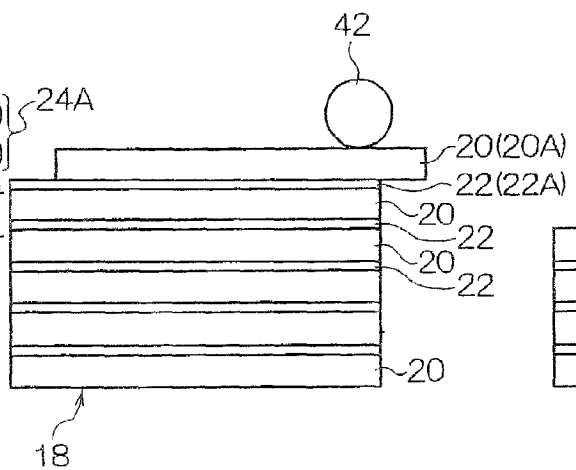
Figure 4A:
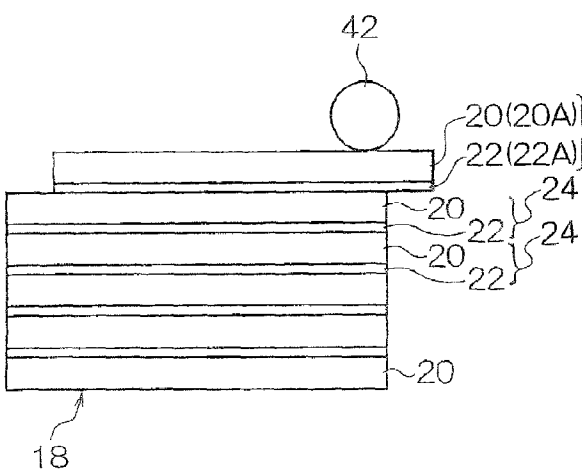
Figure 5B:
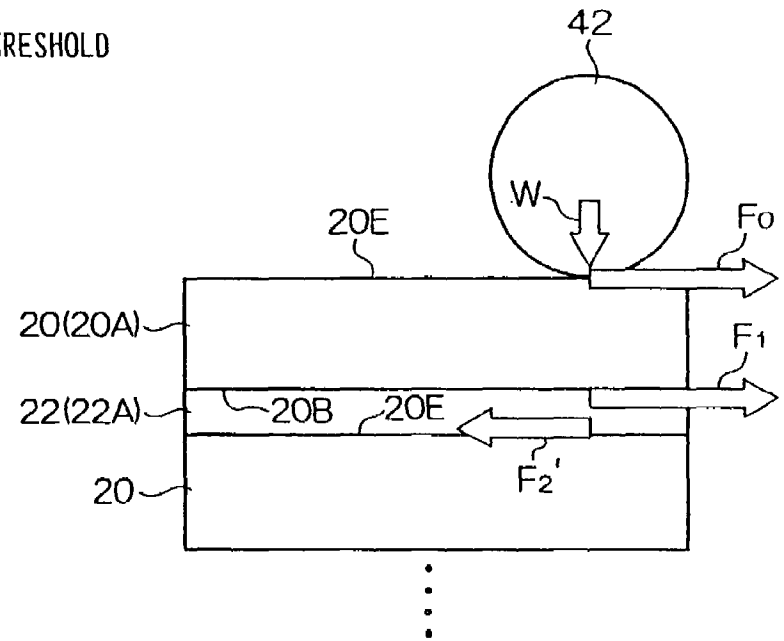
FIG. 5B is an explanatory diagram showing the load and the conveyance forces between the planographic printing plate and a slip-sheet.

The planographic printing plate comprises a sensitizer surface 20E in which a sensitizer is applied to one surface of a plate-shaped base material made of aluminum or the like, as shown in FIG. 5B. As shown in FIG. 4, slip-sheets 22 for protecting the sensitizer surface 20E and planographic printing plates 20 are alternately laminated onto one another to constitute the stack 18. In FIG. 4, the slip-sheets 22 and the planographic printing plates 20 are laminated such that the sensitizer surface 20E is directed upward, and one of the slip-sheets 22 which protects the sensitizer surface 20E of the uppermost planographic printing plate 20 has already been removed. A set comprising one planographic printing plate 20 and the slip-sheet 22 immediately below it in this state is a unit of conveyance for "set feeding" as described below. Therefore, in the following description, this set is called a laminated set 24.

FIGS. 4A to 4C show three modes of the planographic printing plates 20 as extracted with or without the slip-sheets 22 by the planographic printing plate feeding apparatus 12. FIG. 4A shows a mode in which the uppermost set 24A, i.e., the uppermost planographic printing plate 20A and the slip-sheet 22A immediately below it are extracted from the stack 18 as one set, which mode is hereinafter referred to as "set feeding". FIG. 4B shows a mode in which the slip-sheet 22 is not extracted and only one planographic printing plate 20 is extracted. This is called "single feeding" hereinafter. "Single feeding" also includes a mode in which only the slip-sheet 22 is extracted, when the slip-sheet 22 is located at the uppermost position. FIG. 4C shows a mode in which plural sets 24 are extracted, and this is called "multiple feeding" hereinafter. In this embodiment, by adjusting a load W applied to the stack 18 from a pickup roller 42, unintentional multiple feeding is prevented and at least set feeding can be carried out reliably (preferably, set feeding and single feeding can be switched freely). A feeding direction of the planographic printing plate 20 is indicated by arrow F, and a direction perpendicular to the feeding direction (widthwise direction of the planographic printing plate 20) is indicated by arrow W (see FIG. 2).

The planographic printing plate feeding apparatus 12 includes a table 26. The mounting unit 14 and the feeding unit 16 are disposed on the table 26. Casters 28 are mounted on the table 26 so that the entire planographic printing plate feeding apparatus 12 can be moved and can, for example, be attached to or detached from a planographic printing plate inserting portion of an exposure apparatus.

As shown in FIG. 2, the mounting unit 14 includes a flat and rectangular mounting tray 30. Two side end guide plates 32 and one rear end guide plate 34 are disposed in the mounting tray 30. The side end guide plates 32 are slid in the directions indicated by the arrow W by a slide mechanism (not shown), and neatly align side surfaces of the stack 18, i.e., of the plural laminated sets 24, in accordance with the size of the planographic printing plate 20. Similarly, the rear end guide plate 34 is slid in the direction indicated by the arrow F (and the opposite direction thereto) by a slide mechanism (not shown) and neatly aligns rear ends of the stack 18 (the plural laminated sets 24).

The mounting unit 14 is provided with plural covers 36 so as to cover the periphery of the mounted stack 18. The cover 36A covers downstream ends of the stack 18 in the conveyance direction. When the cover 36A is connected to an exposure apparatus or the like, the cover 36A is pushed upward by a pushing member (not shown) and turned around a hinge 38 as shown in FIG. 1, thereby jumping upward.

A holder 40 is provided above the mounting unit 14 along a widthwise direction of the planographic printing plate 20. A pickup roller 42 is rotatably mounted on the holder 40 such that the pickup roller 42 is located above the stack 18 mounted on the mounting unit 14. A driving force of a driving motor 44 is applied through an endless belt 46 and (forwardly) rotates in the conveyance direction of the planographic printing plate 20 (or the slip-sheet 22).

The holder 40 can turn around support shafts 48 provided downstream of the conveyance direction at opposite ends in the widthwise direction. The holder 40 moves between a conveyance position where the pickup roller 42 comes into contact with and the predetermined load W is applied to the stack 18, and a separated position where the pickup roller 42 is separated from the stack 18 by a rotational driving force from a drive unit 50 provided laterally of the holder 40.

As shown in FIG. 5B, a conveyance force applied from the pickup roller 42 to the uppermost planographic printing plate 20A is defined as F0, a conveyance force applied from the back surface 20B (surface on which the sensitizer is not applied) of the planographic printing plate 20 to the slip-sheet 22 is defined as F1, the maximum static friction force between the back surface 20B and the slip-sheet 22 is defined as F1' (not shown), and a maximum static friction coefficient thereof is defined as $\mu 1$. Further, a conveyance force applied from the slip-sheet 22 to the sensitizer surface 20E of the planographic printing plate 20 is defined as F2 (not shown), the maximum static friction force between the slip-sheet 22 and the sensitizer surface 20E is defined as F2', and the maximum static friction coefficient thereof is defined as $\mu 2$. Here, generally, the relations between these elements are:

$$\mu 1<\mu 2, \text{ and}$$

$$F1'<F2'.$$

Figure 5A:
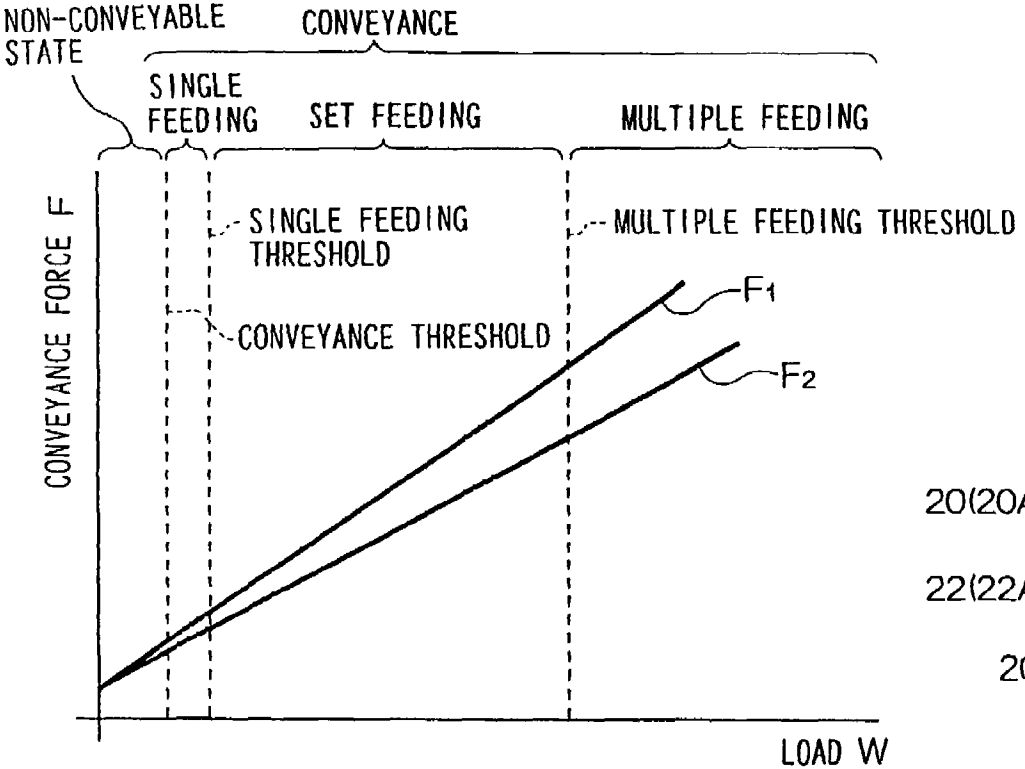
FIG. 5A is a graph showing a relationship between conveyance force and load from a pickup roller of the planographic printing plate feeding apparatus.

As can be seen from the graph shown in FIG. 5A, if the load W is gradually increased from 0, since the conveyance force F0 is small at the initial stage, the planographic printing plate 20 cannot be conveyed (non-conveyable state). However, if the load W exceeds the conveyance threshold, the conveyance force F0 applied to the uppermost planographic printing plate 20 becomes greater than the maximum static friction force F1' between the back surface 20B and the slip-sheet 22, and the uppermost planographic printing plate 20 can be conveyed. At this time, if the conveyance force F1 applied to the slip-sheet 22 from the back surface 20B of the planographic printing plate 20 is in a range of $$F1'<F1<F2',$$

only the uppermost planographic printing plate 20A is conveyed (single feeding). That is, since the conveyance force F1 applied to the slip-sheet 22 is smaller than the maximum static friction force F2' between the lower surface of the slip-sheet 22 and the sensitizer surface 22E of the next planographic printing plate 20, the slip-sheet 22 is not conveyed.

If the load W further increases and exceeds the single feeding threshold, the conveyance force F1 applied to the slip-sheet 22 is increased to such a degree that the relation $$F2'<F1$$

is satisfied, and the uppermost planographic printing plate 20A and the slip-sheet 22A can be conveyed integrally (set feeding). Therefore, by adjusting the load W appropriately to satisfy the above relation, the conveyance mode can be freely switched between single feeding and set feeding in this embodiment.

Even when the slip-sheet 22A rather than the planographic printing plate 20A is located uppermost on the stack 18, if the load W is set such that the relation $$F2'<F1$$

is satisfied, it is possible to convey only the slip-sheet 22A in a single feeding mode.

If the load W is further increased and exceeds the multiple feeding threshold in the graph shown in FIG. 5A, the conveyance force F2 applied from the uppermost slip-sheet 22A to the planographic printing plate 20 immediately below the uppermost slip-sheet 22A becomes greater than the maximum static friction force F2', and multiple feeding occurs. Therefore, in this embodiment, the upper limit of the load W is limited such that unintentional multiple feeding is not caused.

The bottom portion of the mounting tray 30 is a mounting plate 52 which is oscillated by a hinge (not shown) provided upstream in the conveyance direction. The mounting plate 52 is impelled upward by a impelling member (not shown) in a state in which the stack 18 is mounted on the mounting plate 52, so that the uppermost planographic printing plate 20 (or slip-sheet 22) reliably comes into contact with the pickup roller 42 (see FIG. 2).

Figure 3:
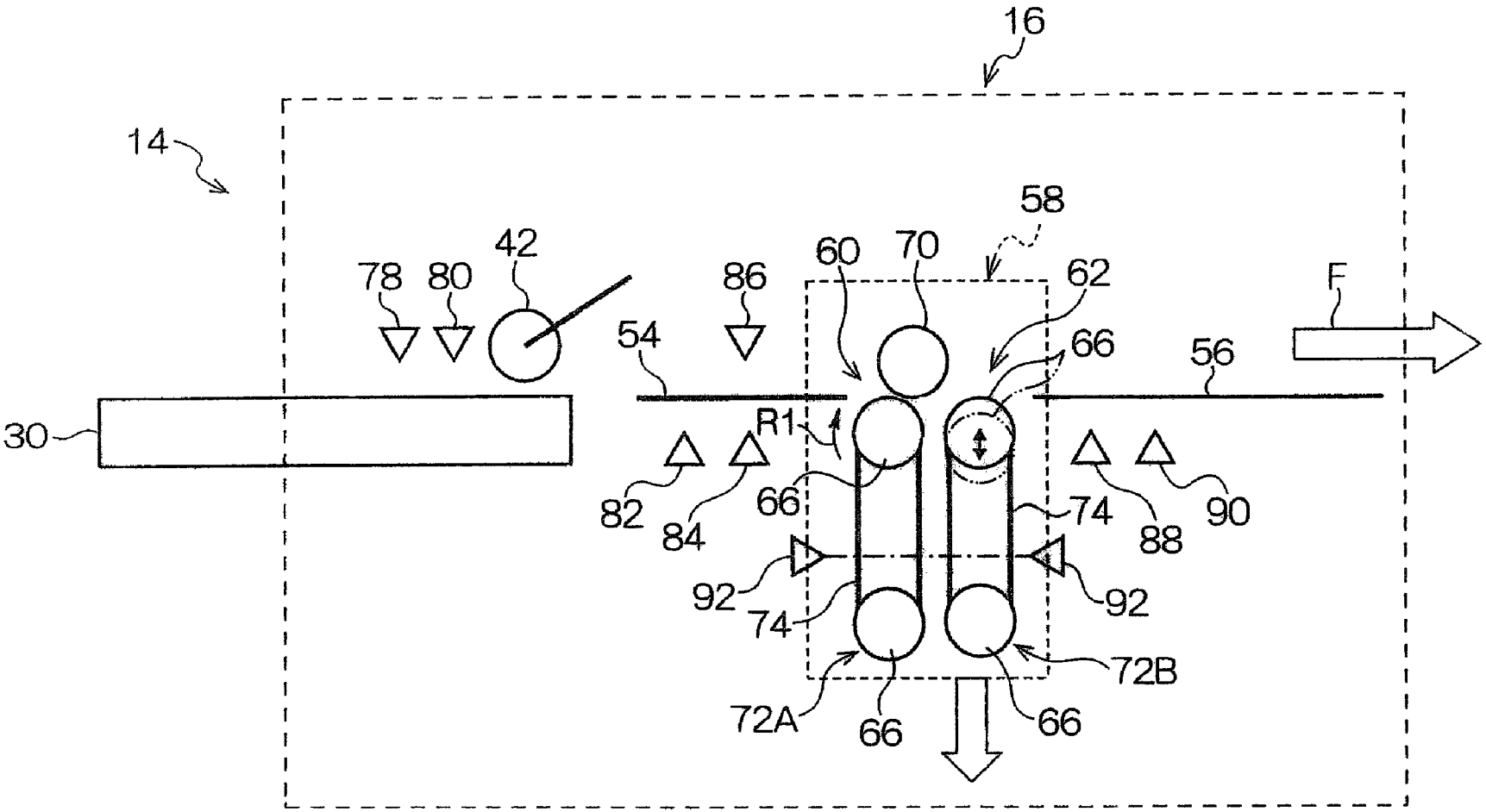
FIG. 3 is a schematic side view showing the mounting unit and the feeding unit of the first embodiment of the planographic printing plate feeding apparatus of the invention.

As shown in FIG. 3, two guide plates 54 and 56 are disposed at a predetermined distance from each other in the conveyance direction downstream from the mounting unit 14 in the conveyance direction. The planographic printing plate 20 is supported by the guide plates 54 and 56 while being conveyed.

A slip-sheet separating unit 58 is disposed between the guide plates 54 and 56. The slip-sheet separating unit 58 includes a conveyance roller unit 60 and a retard roller unit 62 disposed in this order along the conveyance direction. Each of these units comprises a rotatable shaft 64 provided along a widthwise direction, and rubber rollers 66 fixed to the shaft 64 at predetermined distances from one another. When rotated by a driving force from a driving motor 61, the rubber rollers 66 of the conveyance roller unit 60 rotate in the direction of the arrow R1 (forward rotation), and the rubber rollers 66 of the retard roller unit 62 rotate in the direction opposite to the arrow R1 (reverse rotation).

Figure 6B:
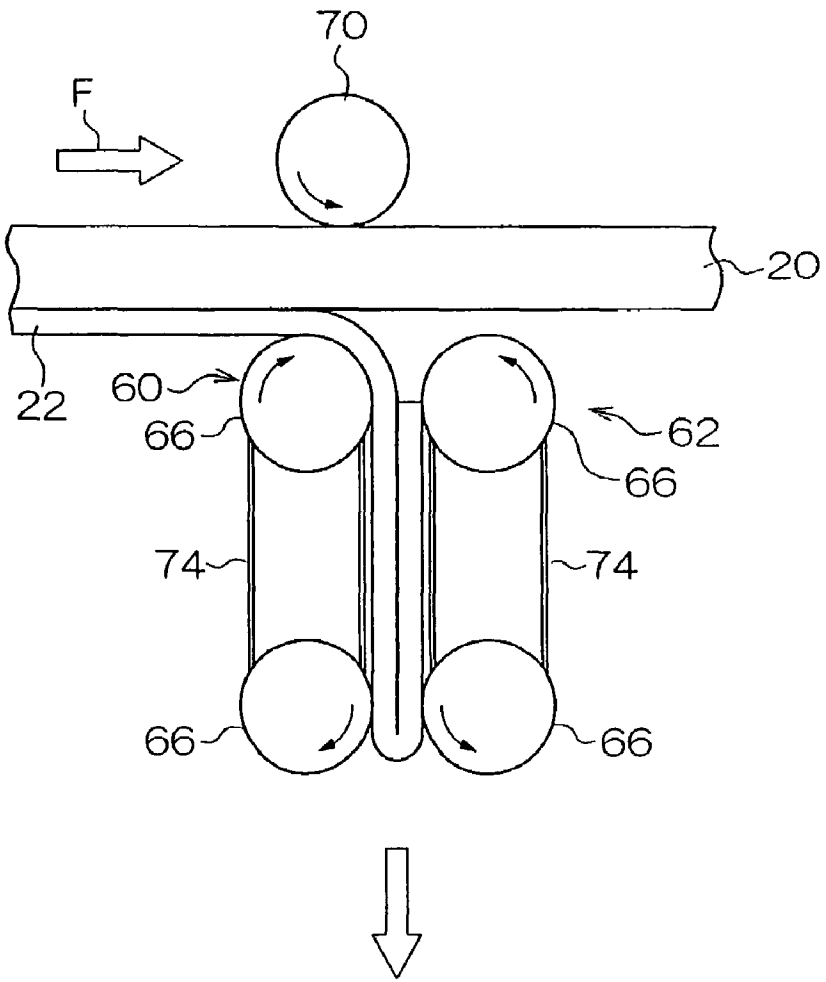
Figure 6A:
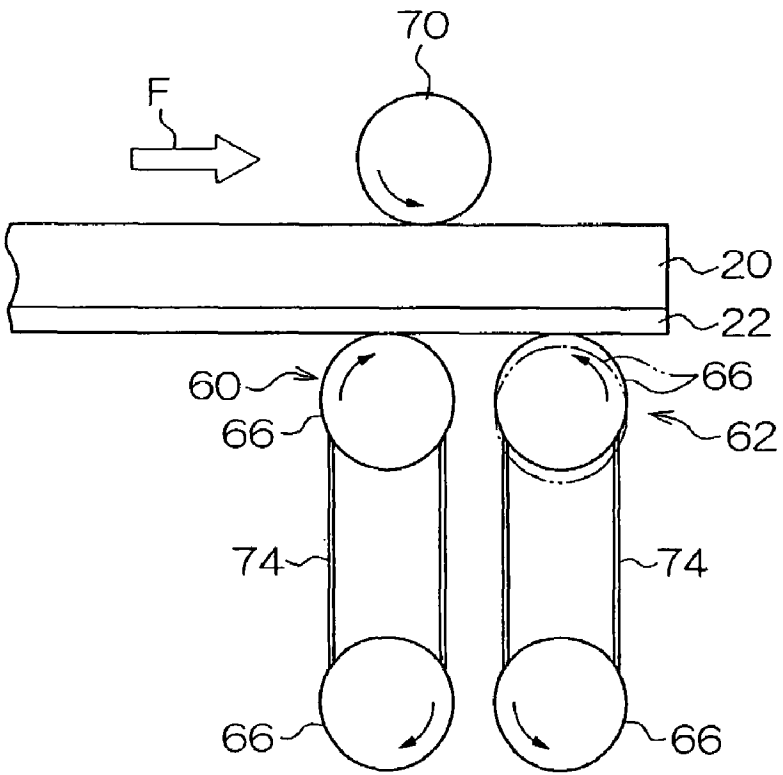

The retard roller unit 62 moves (vertically) between a first contact position (position shown with solid lines in FIGS. 3 and 6A), a second contact position (position shown with solid line in FIG. 8A) where the retard roller unit 62 comes into contact with the slip-sheet 22 which is being conveyed by a drive unit 68 provided on the one end side of the retard roller unit 62, and a separated position (position shown with a dashed line in FIG. 3) where the retard roller unit 62 is disposed at a remove from the slip-sheet 22. The second contact position is a position of the retard roller unit 62 when only the slip-sheet is conveyed. This will be described below. In the first contact position, the retard roller unit 62 reversely rotates in a state in which the retard roller unit 62 is in contact with the slip-sheet 22 and, therefore, the slip-sheet 22 can be separated from the planographic printing plate 20. The rubber rollers 66 of the retard roller unit 62 come into contact with the rubber rollers 66 of the conveyance roller unit 60 so that the slip-sheet 22 can be nipped between the rubber rollers 66 of the conveyance roller unit 60 as shown in FIG. 6B.

A nip roller 70 is rotatably provided above the conveyance roller unit 60 in the widthwise direction. The nip roller 70 contacts with the rubber roller 66 of the conveyance roller unit 60 so that it can nip the planographic printing plate 20 and the slip-sheet 22 between itself and the rubber rollers 66 of the conveyance roller unit 60 by its own weight. When the rubber rollers 66 of the conveyance roller unit 60 rotate in the direction of the arrow R1 in the nipped state, the planographic printing plate 20 and the slip-sheet 22 are conveyed in the direction of the arrow F. As can be seen from FIGS. 3, 6A and 6B, a gap of a size such that the planographic printing plate 20 and the slip-sheet are not nipped therebetween is formed between the nip roller 70 and the rubber rollers 66 of the retard roller unit 62.

Slip-sheet conveyance roller units 72A and 72B are disposed below the conveyance roller unit 60 and the retard roller unit 62, respectively. Similarly to the conveyance roller unit 60 and the retard roller unit 62, the slip-sheet conveyance roller units 72A and 72B also comprise shafts 64 and rubber rollers 66 so that the slip-sheet 22 can be nipped between the rubber rollers 66 of the slip-sheet conveyance roller units 72A and 72B. Endless driving belts 74 are wound around the shaft 64 of the conveyance roller unit 60 and the shaft 64 of the slip-sheet conveyance roller unit 72A, and the slip-sheet conveyance roller unit 72A rotates in synchronization with the conveyance roller unit 60 in the same direction. Similarly, driving belts 74 are also wound around the shaft 64 of the retard roller unit 62 and the shaft 64 of the slip-sheet conveyance roller unit 72B. Therefore, when the rubber rollers 66 of the slip-sheet conveyance roller units 72A and 72B rotate in a state in which the slip-sheet 22 is nipped therebetween, the nipped slip-sheet 22 can be conveyed downward. At this time, the slip-sheet 22 is guided by the driving belts 74.

As shown in FIG. 2, a collection box 76 is provided below the slip-sheet conveyance roller units 72A and 72B, and slip-sheets 22 are collected therein.

As shown in FIGS. 2 and 3, the holder 40 is provided with a presence/absence sensor 78 and a determining sensor 80 upstream from the pickup roller 42 in the conveyance direction. The guide plate 54 is also provided with a presence/absence sensor 82 and a determining sensor 84 in this order from the upstream side. A determining sensor 86 is held by a holding member (not shown) above the presence/absence sensor 82 and the determining sensor 84. Further, the guide plate 56 is provided with a presence/absence sensor 88 and a determining sensor 90 in this order from the upstream side. The presence/absence sensors 78, 82 and 88 detect the presence or absence of the planographic printing plate 20 or the slip-sheet 22. The determining sensors 80, 84, 86 and 90 differentiate between presence or conveyance of a planographic printing plate 20 and those of a slip-sheet 22.

A notch 79 is formed on the mounting plate 52 of the mounting tray 30 in a position corresponding to the presence/absence sensor 78. If the stack 18 (a planographic printing plate 20 or a slip-sheet 22) is mounted on the mounting plate 52, light from the presence/absence sensor 78 is reflected on the planographic printing plate 20, and this reflection light is received. If the stack 18 is not mounted on the mounting plate 52, light from the presence/absence sensor 78 passes through the notch 79. Thus, the presence or absence of the stack 18 can be determined.

Slip-sheet detection sensors 92 are disposed between the conveyance roller unit 60 and the retard roller unit 62 on the one hand and the slip-sheet conveyance roller units 72A and 72B on the other, which can detect passage of the slip-sheet 22.

Detection information by the presence/absence sensors 78, 82 and 88, the determining sensors 80, 84, 86 and 90 and the slip-sheet detection sensors 92 are sent to a control unit (not shown), and the control unit controls various sections of the planographic printing plate feeding apparatus 12 based on the detection information.

When a planographic printing plate 20 is to be fed to the exposure apparatus by the planographic printing plate feeding apparatus 12 having the above-described structure, the stack 18 is first mounted on the mounting unit 14. At this time, the stack 18 is aligned such that the rear end 18B of the stack 18 contacts with the rear end guide plate 34 and the side ends 18S of the stack 18 contact with the side end guide plates 32.

Then the planographic printing plate feeding apparatus 12 is connected to a predetermined position of the exposure apparatus, the cover 36A turns upward and a portion (a portion in the vicinity of a front end) of the stack 18 is exposed as shown in FIG. 1.

In this state, since the presence/absence sensor 78 detects the presence or absence of planographic printing plates 20 or slip-sheets 22 in the mounting unit 14, the holder 40 is driven by the drive unit 50 and the pickup roller 42 comes into contact with the stack 18 as shown in FIG. 4A.

Here, the load W applied from the pickup roller 42 to the stack 18 is adjusted in accordance with a case where only a planographic printing plate 20A is conveyed in single feeding mode, or a case where a planographic printing plate 20A and a slip-sheet 22A are conveyed as one set in set feeding mode (set 24A is conveyed as one unit). Therefore, single feeding mode and set feeding mode can be freely interchanged. The separating operation of a slip-sheet 22 from a planographic printing plate 20 by the slip-sheet separating unit 58 in set feeding mode will first be explained below.

During the conveying operation, on the basis of a determination that the feeding mode is the set feeding mode based on a result detected by the presence/absence sensor 82 and the determining sensors 84 and 86, the conveyance roller unit 60 and the pickup roller unit 62 are rotated. Further, if the presence/absence sensor 88 and the determining sensor 90 detect that the planographic printing plate 20 and the slip-sheet 22 are conveyed in the set feeding mode, the retard roller unit 62 moves upward to the position shown with the solid line in FIG. 6A. The rubber rollers 66 of the retard roller unit 62 reversely rotate and come into contact with the slip-sheet 22. Thus, since a force from the conveyance roller unit 60 in the conveyance direction and a force from the retard roller unit 62 in the direction opposite to the conveyance direction are applied, the slip-sheet 22 can be separated from the planographic printing plate 20. The slip-sheet 22 is sandwiched between the rubber rollers 66 of the conveyance roller unit 60 and the retard roller unit 62 and conveyed downward in a state in which the slip-sheet 22 is folded in the middle portion thereof. In this manner, the presence/absence sensor 88 detects that the planographic printing plate 20 exists, and the determining sensor 90 detects that the slip-sheet 22 does not exist, i.e., that the slip-sheet 22 has been removed from the planographic printing plate 20. The slip-sheet detection sensors 92 detect whether the slip-sheet 22 has passed, and after a predetermined time (e.g., 5 seconds) has elapsed since a rear end of the slip-sheet 22 passed, the conveyance roller unit 60 and the retard roller unit 62 are stopped, and the retard roller unit 62 is lowered to the separated position.

Then, the planographic printing plate 20 from which the slip-sheet 22 is separated is detected by the presence/absence sensor 88 and the determining sensor 90. The planographic printing plate 20 is further conveyed and fed into the exposure apparatus. The slip-sheets 22 are collected in the collection box 76.

Figure 7:
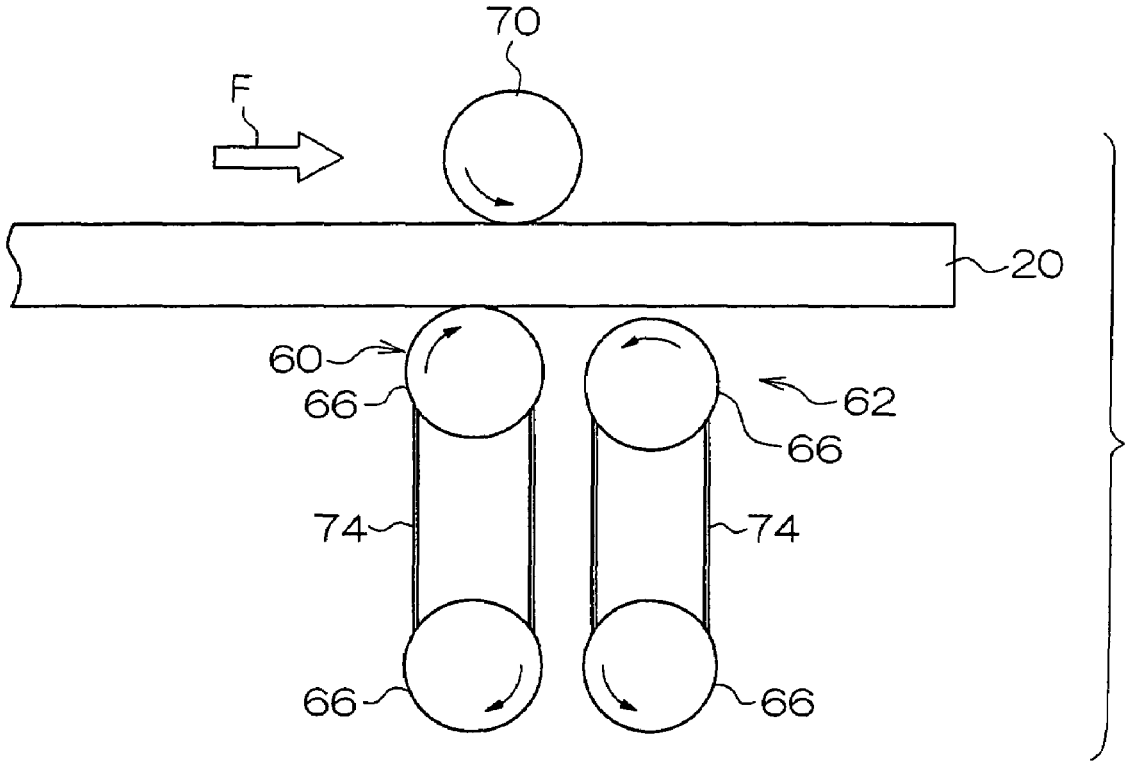
FIG. 7 is an explanatory diagram showing conveyance of the planographic printing plate at the slip-sheet separating unit in the first embodiment of the planographic printing plate feeding apparatus of the invention.

On the other hand, when only the planographic printing plate 20 is fed in the single feeding mode, the retard roller unit 62 stays in the separated position while the rubber rollers 66 continue to reversely rotate as shown in FIG. 7, based on the detection results of the presence/absence sensor 82 and the determining sensors 84 and 86. Therefore, the rubber rollers 66 of the retard roller unit 62 do not come into contact with the planographic printing plate 20, and the planographic printing plate 20 is conveyed as it is and fed to the exposure apparatus.

Figure 8B:
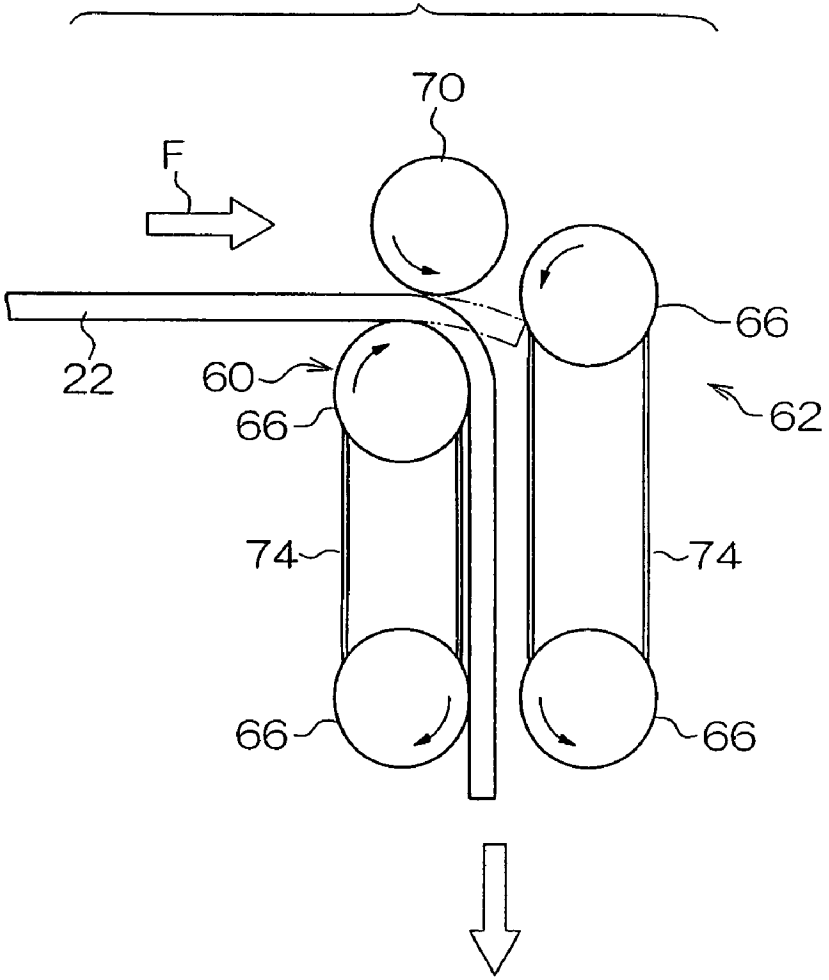
Figure 8A:
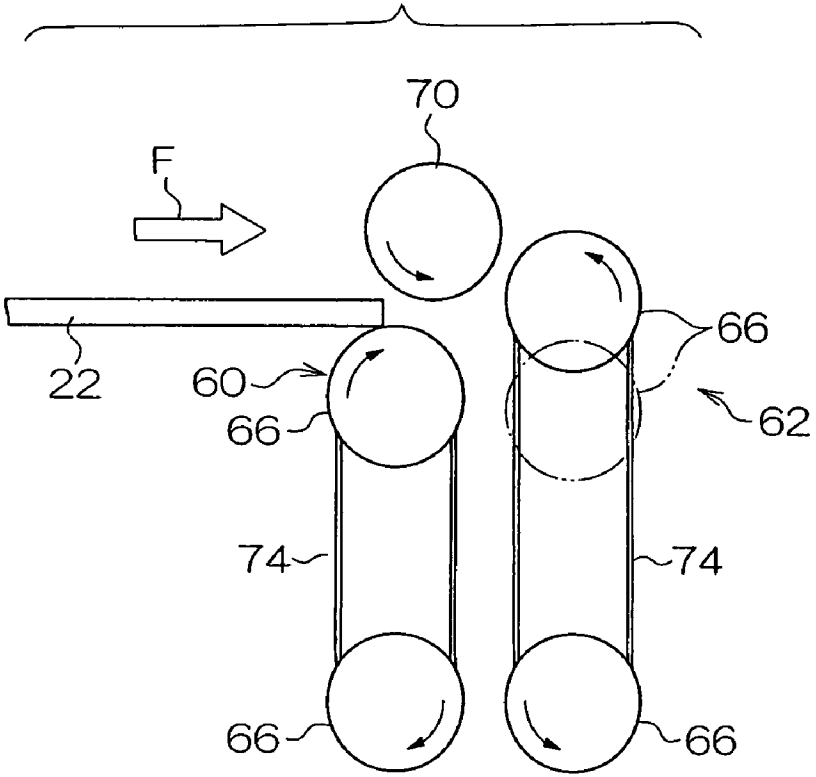

When only the slip-sheet 22 is fed in the single feeding mode, the retard roller unit 62 moves upward toward the second contact position before the tip end of the slip-sheet 22 reaches the second contact position, while the rubber rollers 66 keep rotating reversely as shown in FIG. 8A, based on the detection results of the presence/absence sensor 82 and the determining sensors 84 and 86. Then, since the rubber rollers 66 of the retard roller unit 62 enter the conveyance path of the slip-sheet 22, the tip end of the conveyed slip-sheet 22 abuts against the rubber rollers 66 as shown in FIG. 8B, and the slip-sheet 22 is guided downward. Then, the slip-sheet 22 is sandwiched between the rubber rollers 66 of the conveyance roller unit 60 and the retard roller unit 62 and conveyed downward. When a predetermined time has elapsed after the slip-sheet detection sensors 92 detect that the rear end of the slip-sheet 22 has passed, the conveyance roller unit 60 and the retard roller unit 62 are stopped, and the retard roller unit 62 is lowered to the separated position.

The slip-sheet separating unit 58 of the first embodiment is not necessarily configured such that the retard roller unit 62 rotates in a state in which the rubber rollers 66 thereof contact with the rubber rollers 66 of the conveyance roller unit 60. For example, a driving motor which rotates the retard roller unit 62 may further be provided, and the retard roller unit 62 may be rotated independently from the conveyance roller unit 60.

The retard roller unit 62 need not rotate at the same peripheral speed as that of the conveyance roller unit 60 in the opposite direction to the conveyance roller unit 60. For example, even if the retard roller unit 62 rotates in the same direction as that of the conveyance roller unit 60, if the peripheral speed of the retard roller unit 62 is slower than that of the conveyance roller unit 60, the slip-sheet 22 can be sagged between the conveyance roller unit 60 and the retard roller unit 62 and the slip-sheet 22 can be separated from the planographic printing plate 20. However, it is preferable that the retard roller unit 62 is rotated at the same peripheral speed as that of the conveyance roller unit 60 in the opposite direction from the conveyance roller unit 60 because the slip-sheet 22 can be sandwiched between the rubber rollers 66 and conveyed without slipping.

Figure 9B:
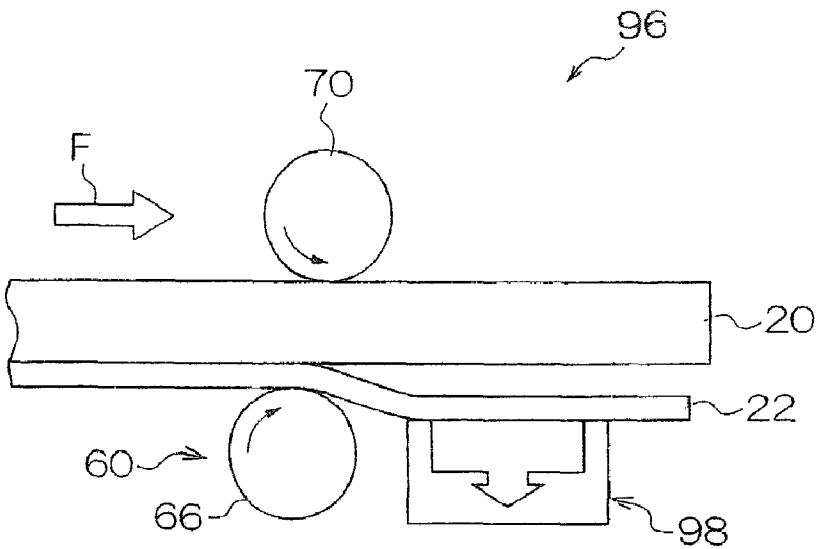
Figure 9A:
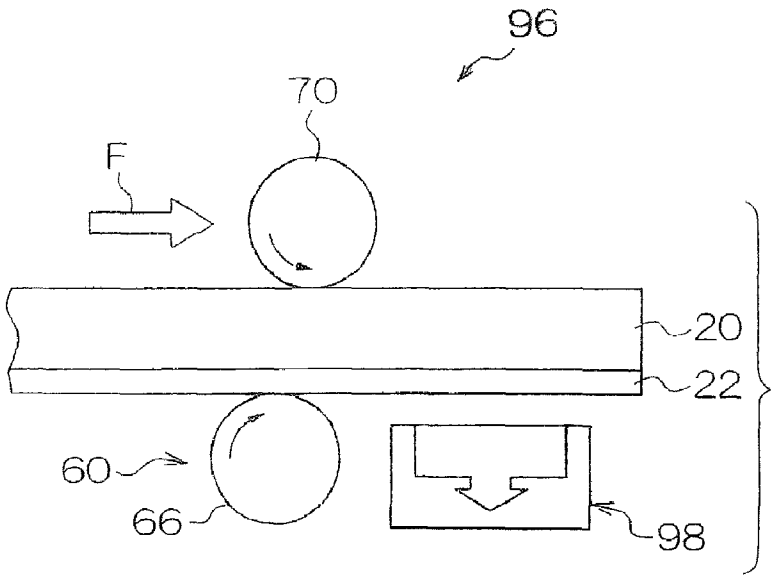

FIGS. 9A and 9B show a slip-sheet separating unit 96 of a second embodiment of the invention. In the second embodiment of the planographic printing plate feeding apparatus, only the slip-sheet separating unit is different from that of the first embodiment. The other structures are the same as those of the first embodiment. Therefore, detailed explanation of the corresponding portions is omitted.

In a slip-sheet separating unit 96 of the second embodiment, a suction fan 98 which suctions the slip-sheet 22 by air is provided instead of the retard roller unit 62 of the first embodiment. The suction fan 98 is disposed downstream from the conveyance roller unit 60 in the conveyance direction and at a position where the suction fan 98 will not contact against the slip-sheet 22. As shown in FIG. 9A, when the suction fan 98 is OFF, the suction fan 98 does not suction the slip-sheet 22. If the suction fan 98 is turned ON as shown in FIG. 9B, the slip-sheet 22 can be separated from the planographic printing plate 20. The separated slip-sheet 22 is conveyed by a slip-sheet conveyance roller (not shown) or the like, and can be collected in the collection box 76 (see FIG. 1) as in the first embodiment.

In the second embodiment, when only the planographic printing plate 20 is fed in the single feeding mode, the suction fan 98 may be turned OFF so that the planographic printing plate 20 is not suctioned. When only the slip-sheet 22 is fed in the single feeding mode, the suction fan 98 may be turned ON to suction the slip-sheet 22.

As explained above, in each embodiment of the invention, by adjusting the load W applied to the stack 18 from the pickup roller 42, the invention enables reliable switching between the single feeding mode and the set feeding mode while feeding. In the case of the set feeding mode, as compared with the single feeding mode in which the planographic printing plates 20 or the slip-sheets 22 are fed successively, it is possible to feed the planographic printing plates 20 more swiftly. In a structure in which planographic printing plates 20 and slip-sheets 22 are separately extracted, extraction mechanisms corresponding to both plates and slip-sheets are required; however, in the present invention it is possible to extract both using one pickup roller 42. Thus, separate extraction mechanisms are unnecessary. Further, unlike conventional techniques, it is unnecessary to use a suction cap and thus the structure of the present invention can be compact in size, simple and inexpensive.

In the above explanation, the load W from the pickup roller 42 is adjusted such that the planographic printing plate 20 and the slip-sheet 22 are fed in single feeding mode or set feeding mode. However, in certain kinds of exposure apparatus plural sets of stacked planographic printing plates 20 and the slip-sheets 22 can be separated. Therefore, in such a case, the load W of the present invention may be adjusted in order to actively conduct multiple feeding.

The planographic printing plate 20 to be fed in the present invention is not especially limited, but it is preferable to use a planographic printing plate 20 which will not be unduly affected by the load W applied from the pickup roller 42. In particular, since it can be assumed that the load W will be actively increased in the invention, a planographic printing plate in which a so-called pressure-induced fog is not generated even if a large load is applied is preferable. More specifically, a preferable example is a photopolymer type planographic printing plate having generally ten times or more robust against an external force as compared with a thermal type planographic printing plate.

What is claimed is:

1. A planographic printing plate feeding apparatus comprising:

a mounting unit on which a stack of laminated sets comprising planographic printing plates and slip-sheets is mounted;

a conveyance unit which can convey an uppermost set by applying a load and a conveyance force to a set stacked at an uppermost portion of the stack; and a drive unit which drives the conveyance unit and adjusts the load applied to the uppermost set from the conveyance unit, wherein the drive unit at least adjusts the load applied to the uppermost set in a range such that the conveyance force (F0) applied to the uppermost set exceeds a maximum static friction force (F2') between the uppermost set and a next set;

wherein the conveyance unit includes a conveyance roller which comes into contact with the uppermost set and rotates while applying the load to the uppermost set, thereby applying the conveyance force.

2. The planographic printing plate feeding apparatus according to claim 1, wherein the load applied by the conveyance unit is variable.

3. The planographic printing plate feeding apparatus according to claim 2, wherein the set comprises an upper planographic printing plate and a slip-sheet laminated on a lower surface of the upper planographic printing plate, the load can be switched between a first load value and a second load value, the first load value is in a range such that a conveyance force (F1) applied to the slip-sheet of the uppermost set is greater than a first maximum static friction force (F1') between the planographic printing plate and the slip-sheet of the uppermost set, and is smaller than a second maximum static friction force (F2') between the slip-sheet of the uppermost set and a planographic printing plate of the next set, and the second load value is in a range such that the conveyance force (F1) applied to the slip-sheet of the uppermost set is greater than the second maximum static friction force (F2').

4. The planographic printing plate feeding apparatus according to claim 1, wherein the load applied by the conveyance unit is variable.

5. The planographic printing plate feeding apparatus according to claim 4, wherein the set comprises an upper planographic printing plate and a slip-sheet laminated on a lower surface of the planographic printing plate, the load can be switched between a first load value and a second load value, the first load value is in a range such that a conveyance force (F1) applied to the slip-sheet of the uppermost set is greater than a first maximum static friction force (F1') between the planographic printing plate and the slip-sheet of the uppermost set, and is smaller than a second maximum static friction force (F2') between the slip-sheet of the uppermost set and a planographic printing plate of the next set, and the second load value is in a range such that the conveyance force (F1) applied to the slip-sheet of the uppermost set is greater than the second maximum static friction force (F2').

6. The planographic printing plate feeding apparatus according to claim 1, further comprising a separating unit which separates the slip-sheet of a set conveyed by the conveyance unit from the planographic printing plate of the set.

7. The planographic printing plate feeding apparatus according to claim 1, wherein the drive unit switches the load applied from the conveyance unit between a first load in which the uppermost single set is conveyed, and a second load in which a single planographic printing plate or slip-sheet is conveyed.

8. A planographic printing plate feeding apparatus in which laminated sets respectively comprising a planographic printing plate and a slip-sheet are laminated in a thickness direction to form a stack, and planographic printing plates are successively fed therefrom, the planographic printing plate feeding apparatus comprising:

a conveyance unit which can convey an end surface set by applying a load and a conveyance force to a set at an end surface of the stack in a laminated direction; and a drive unit which drives the conveyance unit and adjusts the load applied to the end surface set from the conveyance unit, wherein the drive unit at least adjusts the load applied to the end surface set in a range such that the conveyance force (F0) applied to the end surface set exceeds a maximum static friction force (F2') between the end surface set and a next set; and a separating unit which separates the slip-sheet of the set conveyed by the conveyance unit from the planographic printing plate of the set;

wherein the conveyance unit comprises a conveyance roller which comes into contact with the end surface set and rotates while applying a load to the end surface set, thereby applying the conveyance force.

9. The planographic printing plate feeding apparatus according to claim 8, wherein the load applied by the conveyance unit is variable.

10. The planographic printing plate feeding apparatus according to claim 9, wherein the set comprises a planographic printing plate located at an end surface in the laminated direction and a slip-sheet laminated on a lower surface of the planographic printing plate, the load can be switched between a first load value and a second load value, the first load value is in a range such that a conveyance force (F1) applied to the slip-sheet of the end surface set is greater than a first maximum static friction force (F1') between the planographic printing plate and the slip-sheet of the end surface set, and is smaller than a second maximum static friction force (F2') between the slip-sheet of the end surface set and a planographic printing plate of the next set, and the second load value is in a range such that the conveyance force (F1) applied to the slip-sheet of the end surface set is greater than the second maximum static friction force (F2').

11. The planographic printing plate feeding apparatus according to claim 8, wherein the load applied by the conveyance unit is variable.

12. The planographic printing plate feeding apparatus according to claim 11, wherein the set comprises a planographic printing plate located at an end surface in the laminated direction and a slip-sheet laminated on a lower surface of the planographic printing plate, the load can be switched between a first load value and a second load value, the first load value is in a range such that a conveyance force (F1) applied to the slip-sheet of the end surface set is greater than a first maximum static friction force (F1') between the planographic printing plate and the slip-sheet of the end surface set, and is smaller than a second maximum static friction force (F2') between the slip-sheet of the end surface set and a planographic printing plate of the next set, and the second load value is in a range such that the conveyance force (F1) applied to the slip-sheet of the end surface set is greater than the second maximum static friction force (F2').

13. The planographic printing plate feeding apparatus according to claim 8, wherein the separating unit comprises a forward-rotating roller which comes into contact with a slip-sheet which is being conveyed and which rotates in the same direction as a conveyance direction, and a reversely-rotating roller which comes into contact with the slip-sheet at a location downstream of the forward-rotating roller in the conveyance direction, and which relatively rotates in a direction opposite to the forward-rotating roller.

14. The planographic printing plate feeding apparatus according to claim 13, wherein the reversely-rotating roller can move between a contact position where the reversely-rotating roller comes into contact with the slip-sheet and a separated position where the reversely-rotating roller is disposed at a position remote from the slip-sheet.

15. The planographic printing plate feeding apparatus according to claim 8, wherein the separating unit comprises a suction unit which suctions the slip-sheet and separates the slip-sheet from the planographic printing plate.

16. The planographic printing plate feeding apparatus according to claim 8, further comprising a detection sensor which is disposed upstream of the separating unit in a conveyance direction for detecting the presence or absence of the planographic printing plate and the slip-sheet.

17. The planographic printing plate feeding apparatus according to claim 8, wherein the drive unit switches the load applied from the conveyance unit between a first load in which the uppermost single set is conveyed, and a second load in which a single planographic printing plate or slip-sheet is conveyed.

* * * * *